US006289938B1

(12) United States Patent
Dewispelaere

(10) Patent No.: US 6,289,938 B1
(45) Date of Patent: Sep. 18, 2001

(54) PILE YARN SELECTION SYSTEM FOR GRIPPER AXMINSTER WEAVING MACHINES

(75) Inventor: Andre Dewispelaere, Marke/Kortrijk (BE)

(73) Assignee: N. V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/626,392

(22) Filed: Jul. 26, 2000

(30) Foreign Application Priority Data

Sep. 28, 1999 (BE) ..... 09900644

(51) Int. Cl.[7] ..... D03D 39/08; D05C 15/18
(52) U.S. Cl. ..... 139/7 A
(58) Field of Search ..... 139/7 A

(56) References Cited

U.S. PATENT DOCUMENTS 2,915,090 * 12/1959 Parsons et al. ..... 139/7 A
5,743,306 * 4/1998 Stewart et al. ..... 139/7 A

FOREIGN PATENT DOCUMENTS 0 379 387 7/1990 (EP) .
1 150 822 5/1969 (GB) .
2 286 601 * 8/1995 (GB) .

* cited by examiner

*Primary Examiner*—Andy Falik
(74) *Attorney, Agent, or Firm*—James Creighton Wray; Meera P. Narasimhan

(57) ABSTRACT

Device for selecting pile yarns (3) in gripper Axminster weaving machines, with a number of elongated pile yarn carriers (1) axially movable according to their length, each of which is provided with a number of compressed air cylinders (8) with a pin (12) for a pile yarn (3), and with electronically controlled means for sending compressed air according to the pattern to the compressed air cylinders (8) in order to make the pin (12) for the selected pile yarn (3) work together with the sliding mechanism (7).

10 Claims, 1 Drawing Sheet

PILE YARN SELECTION SYSTEM FOR GRIPPER AXMINSTER WEAVING MACHINES

BACKGROUND OF THE INVENTION

The invention relates to a device for selecting pile yarns in gripper Axminster weaving machines, more specifically in carpet weaving machines of the gripper Axminster type. With such weaving machines the pile yarns of different colors are placed in a number of elongated pile yarn carriers axially movable according to their length. Each pile yarn carrier is provided for positioning a number of pile yarn ends at mutual distance according to the length of the pile yarn carrier. Each pile yarn carrier is provided with a number of pins at mutual distance according to the length of the pile yarn carrier corresponding to the number of colors. Each pile yarn carrier is under control of a control device according to a pattern, through the pin for the selected pile yarn which works together with a sliding mechanism, axially movable according to its length, in order to present the pile yarn end of the selected pile yarn to an associated gripper jaw for taking up a pile yarn end.

In such carpet weaving machines the pile yarns are held in pile yarn carriers which protrude in a horizontally, obliquely or vertically disposed direction. The pile yarn ends protrude out of the pile yarn carriers sufficiently on one side in order to be taken along by gripper jaws. The gripper jaws are rotatably disposed in order to grip the protruding pile yarn ends in an upwardly rotating movement and in order to bring these downward, so that they can be woven into the backing fabric of the carpet.

Patent publication GB 1 150 822 describes a known jacquard device for selecting pile yarns with a different color in gripper Axminster weaving machines. This jacquard device provides horizontally disposed pile yarn carriers, which are moved in a horizontal direction, so that the pile yarn with the selected color is brought to the pick line of the gripper jaws. With these weaving machines the pile yarns extend in an almost vertical direction. In order that the gripper jaws would be able to take up a selected color according to pattern, the various pile yarns are placed next to each other in one and the same pile yarn carrier. This arrangement is favorable for achieving a high weaving speed.

The selected color according to the pattern to be woven is therefore obtained by a sliding of the pile yarn carriers performed by a jacquard device, in a common horizontal plane, until the pile yarn with the selected color comes to lie just above the pick line of the gripper jaws. With GB 1 150 822 the selection occurs by means of a paper card as data carrier. This device has a card switching device and an pressing device which pushed a pin corresponding to the color to be selected out of the pile yarn carriers. Through a sliding mechanism the pins are brought into a line through which the pile yarn carriers will slide and therefore the selected color is brought to the line of the gripper jaws. Each color to be selected has a specific position on the card. A perforation in that specific position in the paper card signifies the corresponding color is not selected and no perforation signifies that the corresponding color is selected. The production of a such a perforated paper card is very time-consuming and expensive and the device is rather laborious because a rotating movement and a vertical pressing movement of the prismatic cylinder have to be provided.

SUMMARY OF THE INVENTION

The purpose of the invention is to develop a pile yarn selection system for gripper Axminster weaving machines that is suitable for high weaving speeds and that can be electronically controlled from a control device.

In order to achieve the above mentioned purpose the invention provides a pile yarn selection system for gripper Axminster weaving machines, characterized in that the pile yarn carrier is provided with a number of compressed air cylinders each of which is connected to a pin for a pile yarn, and in that the control device comprises electrically controlled means for sending compressed air according to the pattern to the compressed air cylinders in order to make the pin for the selected pile yarn work together with the sliding mechanism.

By providing the compressed air cylinders for each pile yarn in a pile yarn carrier, and by supplying compressed air to the compressed air cylinders by means of electronically controllable means, high weaving speeds can be achieved and the selection of pile yarns can be electronically controlled from a control device.

In an advantageous embodiment the movement of the pile yarn carriers occurs in a predominantly horizontal direction.

In an advantageous embodiment the electronically controlled means comprise a valve block. The compressed air cylinders are preferably connected to the valve block by flexible compressed air tubes. The compressed air tubes have a length so that the pile yarn carriers can slide in horizontal direction over a length equal to the distance between two pile yarns farthest distant form each other.

According to a preferred embodiment of the invention the control device comprises a control for the electronically driving of the valves of the valve block. According to another preferred embodiment the valve block is connected to a cross beam which functions as compressed air reservoir.

In an advantageous embodiment each pin for a pile yarn is connected to the piston rod of a compressed air cylinder. The pin is preferably brought into one extreme position by driving the compressed air cylinder with compressed air, while it is brought into the other extreme position by spring pressure. According to the preferred embodiment the pin can work together with the sliding mechanism while the corresponding compressed air cylinder is controlled by compressed air.

The characteristics and distinctive features of the invention, and the operation thereof are further explained below with reference to the attached drawing which shows a preferred embodiment of the invention. It should be noted that the specific aspects of this embodiment are only described as preferred example of what is intended in the scope of the above general specification of the invention, and may in no way be interpreted as a restriction on the scope of the invention.

BRIEF DESCRIPTION OF THE DRAWINGS

In this drawing

DETAILED DESCRIPTION

Figure 1:
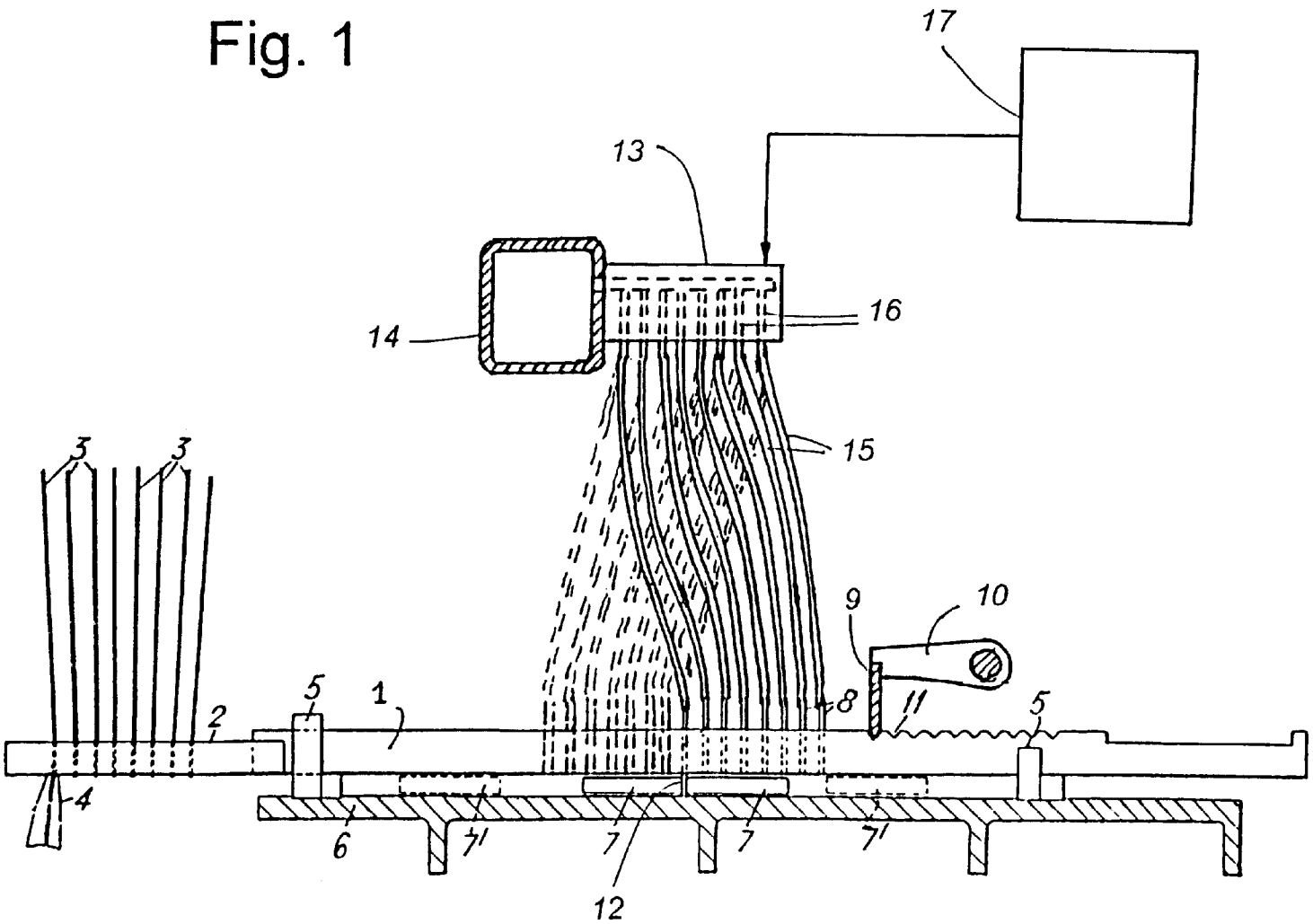
FIG. 1 represents a schematic representation of a side elevation of a device according to the invention.

With the gripper Axminster weaving machine, as depicted in FIG. 1, the pile yarn carriers 1 are disposed horizontally. As is known the pile yarns 3 come from yarn provisions in the weaving creel over a guiding device to a distribution grid that is disposed above the pile yarn carriers 1. Out of this distribution grid the pile yarns 3 are guided almost vertically downward in order to finish up in the pile yarn carriers 1. For each reed space such a pile yarn carrier 1 is provided in order to present the pile yarn 3 to the gripper jaws 4 of a pile gripper working together with it. The pile gripper draws the necessary yarn length from the yarn provision, a cutting device cuts off the drawn yarn length and the gripper jaws 4 turn toward the fell of the fabric in order to have the drawn pile yarn woven in there. It is the intention that the pile yarn carriers 1 select the pile yarn or color that must be woven according to the weaving pattern in order to form pattern designs in the fabric.

In FIG. 1 by way of example eight pile yarns 3 are brought in known manner into a pile yarn carrier 1. Generally any number of pile yarns can be brought into a pile yarn carrier 1. The pile yarn carrier 2 is formed by two elongated walls which are connected together. Between these walls on the one side 2 of the pile yarn carrier 1 the pile yarns 3 are held in known yarn clamping devices at mutual distance from each other. The pile yarn carrier 1 is in a selected position in order to present the leftmost pile yarn 3 to gripper jaws 4. The pile yarns protrude somewhat from the pile yarn carriers 1 so that they can be gripped by the gripper jaws 4 lying below. The selected pile yarns 3 from the various pile yarn carriers 1 are brought to one selection line for the gripper jaws 4 by sliding of the pile yarn carriers 1. The pile yarn carriers 1 extend in the warp direction of the weaving machine. The gripper jaws 4 grip the pile yarns 3 which have been brought to the selection line. The gripper jaws 4 draw a specific pile length out of the pile yarn carriers 1 and a cutting device cuts off the drawn pile yarns from the yarn provision. The gripper jaws 4 rotate toward the fell of the fabric, through which the pile yarn ends are interlaced in the fabric by the weft yarn. The pile yarn carriers 1 are each guided horizontally according to their length by guides 5 which are provided on a supporting table 6.

According to the invention the pile yarn carriers 1 are also for each pile yarn 3 provided with a miniature compressed air cylinder 8. The number of compressed air cylinders 8 is therefore equal to the number of pile yarns 3 per pile yarn carrier 1. The compressed air cylinders 8 are provided between the elongated walls of the pile yarn carrier 1. A pin 12 is connected to the piston rod of each compressed air cylinder 8. The distance between the piston rods of the compressed air cylinders 8, and therefore also the distance between the pins 12, is equal to the distance between the pile yarns 3 in the pile yarn carrier 1.

The control device comprises a valve block 13 with valves 16. The valve block 13 is attached to a cross beam which functions as compressed air reservoir 14. The compressed air cylinders 8 are connected by means of flexible compressed air tubes 15 to the valve block 13. The compressed air tubes 15 are long enough so that the pile yarn carriers 1 can slide in horizontal direction over a length equal to the distance between two pile yarns 3 farthest distant form each other, more especially between the position in full line and the position in dashed line from FIG. 1. When compressed air is sent to a selected compressed air cylinder 8 the corresponding pin 12 for example is pushed out at the bottom of the pile yarn carrier 1. In the absence of compressed air in this example the pin 12 is reset by spring pressure and held in the pile yarn carrier 1. A sliding mechanism with two horizontal sliding knives 7 can work together with a pin 12 which has been pushed out of each pile yarn carrier 1. The device further comprises a knife 9 that can work together with notches 11 of each pile yarn carrier 1 and that is provided on a lever 10.

The device according to the invention further comprises a control device which consists of an electronic control 17 and means, among which the valve block 13, in order to send compressed air according to the pattern to a specific compressed air cylinder 8. For this purpose the valves 16 of the valve blocks 13 are directly controlled by the control 17 according to the pattern to be woven, so that compressed air from the compressed air reservoir 14 is sent via the vales 16 and the compressed air tubes 15 to the corresponding compressed air cylinders 8. When no longer driving the valves 16 compressed air can escape via the valves 16 out of the corresponding compressed air tubes 15 and compressed air cylinders 8.

In order to select the leftmost pile yarn 3 for the time being the sliding knives 7 are moved in known manner away from each other to in the dead points 7', as shown in dashed line in FIG. 1. Then the control 17 commands the valves 16 of the valve block 13 so that compressed air is sent to the left most compressed air cylinder 8, and the corresponding pin 12, as shown in FIG. 1, is brought out of the pile yarn carrier 1. The vertical knife 9 is lifted with a lever 10 in known manner out of the notch 11 of the walls of the pile yarn carrier 1. Subsequently the sliding knives 7 move toward each other to in the position in full line in FIG. 1. Because of this the pin 12, and therefore also the pile yarn carrier 1, are brought into a position whereby the leftmost pile yarn 3 is presented to the gripper jaws 4. This applies to all selected pins 12 of each pile yarn carrier 1, through which those pins 12 are pushed into a row by the sliding knives 7 and the corresponding pile yarns 3 are brought to a selection line for the gripper jaws 4. The knife 9 is brought back with the lever 10 into the notch 11, through which the selection position is secured. From now the knives 7 can again be moved away from each other and a selection of a following pin 12 and corresponding pile yarn 3 can take place in analogue manner.

In an alternative embodiment each pin 12 protrudes under spring pressure out of the pile yarn carrier 1 when no compressed air is present at the corresponding compressed air cylinder 8, while when compressed air is sent to a compressed air cylinder 8 the corresponding pin 12 is held in the pile yarn carrier 1. Moreover the selecting of a pin 12 occurs by sending compressed air to all other compressed air cylinders 8 of the pile yarn carrier 1, while the selected pin 12 is held under spring pressure in the reach of the knives 7 of the sliding mechanism.

In another alternative embodiment by means of controlled valves compressed air is supplied to the compressed air cylinders as desired, so that the piston rods of the corresponding compressed air cylinders are commanded in one or the other direction. Moreover no drawback springs are required any longer.

What is claimed is:

1. A device for selecting pile yarns in gripper Axminster weaving machines comprising plural elongated pile yarn carriers axially movable along their lengths, at least one pile yarn carrier provided for positioning ends of plural pile yarns at mutual distances corresponding to the length of the at least one pile yarn carrier, plural pins on the pile yarn carrier at spaced distances along the length of the at least one pile yarn carrier corresponding to a number ends of the pile yarns, a control device communicating with a respective pin of a selected pile yarn, a sliding mechanism working together with the selected pile yarn according to a pattern to move the sliding mechanism axially according to the length of the pile yarn, gripper jaws for receiving and taking up the selected pile yarn, the at least one pile yarn carrier having plural compressed air cylinders, each air cylinder being connected to a respective pin of a respective pile yarn, the control device comprising electronic controllers for sending compressed air corresponding to a pattern to the compressed air cylinders for enabling the pin for the selected pile yarn to work together with the sliding mechanism.

2. The device of claim 1, wherein the pile yarns are disposed movably on the pile yarn carriers in a generally horizontal direction.

3. The device of claim 1, wherein the electronic controllers further comprise a valve block having at least one valve.

4. The device of claim 3, further comprising compressed air tubes for connecting the compressed air cylinders to the valve block.

5. The device of claim 4, wherein the compressed air tubes have a length for allowing the pile yarn carriers to slide in a horizontal direction over the length equal to a distance between two pile yarns at a farthest distant form each other.

6. The device of claim 3, further comprising a control in the control device for electronically controlling the at least one valve of the valve block.

7. The device of claim 3, further comprising a cross beam forming a compressed air reservoir, wherein the valve block is connected to the cross beam.

8. The device of claim 1, further comprising a piston rod on each compressed air cylinder, wherein each pin for the pile yarn is connected to the piston rod.

9. The device of claim 8, wherein the pin is adapted to be movable to one extreme position when the compressed air cylinder is driven with compressed air, and wherein the pin is adapted to be movable to another extreme position by spring pressure.

10. The device of claim 9, wherein the pin is movable together with the sliding mechanism when a corresponding compressed air cylinder is driven by compressed air.

* * * * *